United States Patent [19]

Kameyama et al.

[11] Patent Number: 4,872,660

[45] Date of Patent: Oct. 10, 1989

[54] SHEET FEED DEVICE FOR RECORDING APPARATUS

[75] Inventors: Toshiaki Kameyama, Tokyo; Yuichi Kobayashi, Yokohama, both of Japan

[73] Assignee: Ricoh Company, Ltd., Tokyo, Japan

[21] Appl. No.: 274,747

[22] Filed: Nov. 21, 1988

Related U.S. Application Data

[63] Continuation of Ser. No. 124,410, Nov. 20, 1987, abandoned, which is a continuation of Ser. No. 826,816, Feb. 6, 1986, abandoned.

[30] Foreign Application Priority Data

Feb. 12, 1985 [JP] Japan ..... 60-24670
Jun. 22, 1985 [JP] Japan ..... 60-93810

[51] Int. Cl.[4] ..... B65H 3/44; B65H 1/08; B65H 3/06

[52] U.S. Cl. ..... 271/9; 271/117; 271/127

[58] Field of Search ..... 271/9, 10, 21, 22, 110, 271/111, 117, 125, 126, 127, 154, 155, 157, 162, 164

[56] References Cited

U.S. PATENT DOCUMENTS

| | | | |
|---|---|---|---|
| 3,655,183 | 4/1972 | Wagner | 271/127 X |
| 4,106,763 | 8/1978 | Tani et al. | 271/127 X |
| 4,307,878 | 12/1981 | Kono | 271/127 X |
| 4,386,769 | 6/1983 | Ito et al. | 271/9 |
| 4,429,863 | 2/1984 | Itoh et al. | 271/9 |
| 4,516,764 | 5/1985 | Tamura | 271/162 X |
| 4,523,752 | 6/1985 | Kigawa et al. | 271/265 X |
| 4,579,328 | 4/1986 | Hagihara et al. | 271/127 X |
| 4,623,137 | 11/1986 | Irie et al. | 271/127 X |
| 4,627,607 | 12/1986 | Ishii | 271/9 X |

FOREIGN PATENT DOCUMENTS

| | | | |
|---|---|---|---|
| 0119636 | 9/1980 | Japan | 271/154 |
| 0009646 | 1/1982 | Japan | 271/9 |
| 0085735 | 5/1982 | Japan | 271/9 |
| 0012026 | 1/1984 | Japan | 271/162 |
| 0039638 | 3/1984 | Japan | 271/127 |
| 0012430 | 1/1985 | Japan | 271/9 |
| 2061231 | 5/1981 | United Kingdom | 271/127 |

OTHER PUBLICATIONS

Fallon et al., Separator/Restraint Paper Feed, IBM Tech. Disclosure Bulletin, Vol. 19, No. 6, Nov. 1976, pp. 1978–1979.

*Primary Examiner*—Joseph J. Rolla
*Assistant Examiner*—Edward S. Ammeen
*Attorney, Agent, or Firm*—Oblon, Spivak, McClelland, Maier & Neustadt

[57] ABSTRACT

A sheet feed device installed in a copier or like recording apparatus for selectively feeding sheets in an automatic and a manual mode. The device include a sensor sensitive to a movement of a manual insertion tray to an operative position away from an inoperative one. When the sensor has sensed such a movement of the tray while a sheet cassette is in a sheet feed position, a drive mechanism which is driven by a DC motor shifts the sheet cassette from the sheet feed position to a standby position. The tray is made up of a front tray and a rear tray which is connected to the front tray in an upward rotatably manner. While the tray is attached to the sheet feed position, a tray guide guides the movement of the front tray to the sheet feed position.

6 Claims, 6 Drawing Sheets

SHEET FEED DEVICE FOR RECORDING APPARATUS

This application is a continuation of application Ser. No. 124,410, filed on Nov. 20, 1987, now abandoned, which is a continuation of application Ser. No. 826,816 filed on Feb. 6, 1986, now abandoned.

BACKGROUND OF THE INVENTION

The present invention relates to a sheet feed device installed in a copier, a printer or like recording apparatus for feeding sheets one at a time and, more particularly, to a sheet feed device capable of allowing sheets to be fed selectively in an automatic and a manual modes.

Prior art sheet feed devices of the type described include a one which is made up of sheet feed means for sequentially picking up and feeding a stack of sheets which are, for example, loaded in a sheet cassette at a sheet loading section, an arm operatively connected to a driver, which includes a DC motor, to push the sheet cassette upwardly from a standby position to a sheet feed position, and a manual insertion tray movable between an operative position adjacent to the sheet feed means and an inoperative position remote from the operative position.

In a sheet feed device having the above construction, in an automatic sheet feed mode, the manual insertion tray is held in the inoperative position so as not to interfere with the operation. In a manual insertion mode, on the other hand, the operator may move the tray to the operative position from the inoperative one. At this instance, since the sheet stack in the sheet cassette is in contact with pick-up rollers of the sheet feed means, the sheet cassette needs to be lowered, or returned, away from the pick-up rollers. In the prior art sheet feed device, while the manual insertion tray is moved to the operative position, the sheet feed cassette is mechanically lowered. Specifically, the driver includes transmission means which is adapted to transmit the rotation of the DC motor to the pusher arm and implemented by a gear mechanism; when the manual insertion tray is moved, it cancels meshing of a part of the gear mechanism via a plurality of lever members while stretching a spring adapted to ensure the meshing.

The problem with such a mechanical cassette lowering scheme is that every time the manual insertion tray is moved from the inoperative position toward the operative position and vice versa, annoying metallic noise is produced at and near the lever members and others. Another problem is that there is an increase in the required number of structural elements and, therefore, the cost is considerable.

Further, the manual insertion tray is mounted rotatably and detachably to a copier or like recording apparatus. This, coupled with the fact that the center of rotation of the tray is located above the pickup rollers of the sheet feed means, the rotatable section inclusive of the tray occupies a substantial space and, thereby, limits the allowable overall length of the tray.

SUMMARY OF THE INVENTION

It is therefore an object of the present invention to provide a sheet feed device which allows for a manual insertion tray to be moved between an operative position and an inoperative position without entailing an unpleasant noise, while cutting down the number of structural elements and, thereby, the cost.

It is another object of the present invention to provide a sheet feed device which reduces the space occupied by a rotary section inclusive of a manual insertion tray and allows the tray to have a longer length.

It is another object of the present invention to provide a generally improved sheet feed device for a recording apparatus.

A sheet feed device for a recording apparatus which selectively performs automatic sheet feed and manual sheet feed of the present invention comprises sheet load means to be loaded with a stack of sheets to be fed, sheet feed means for sequentially picking up and feeding the sheets from a top of the stack which is loaded on the sheet load means, drive means for driving the sheet load means such that the sheet load means is moved from a standby position to a sheet feed position in a sheet feed condition and from the sheet feed position to the standby position in a non-sheet feed condition, manual sheet insert means movable between the sheet feed position and a receded position which is remote from the sheet feed position, sensor means for sensing a movement of the manual insert means from the receded position to the sheet feed position in a manual insertion condition, and control means for controlling the drive means such that when the sensor means has sensed a movement of the manual insert means while the sheet load means is in the sheet feed position, the sheet load means is moved to the standby position away from the sheet feed position.

In accordance with the present invention, a sheet feed device the installed in a copier or like recording apparatus, for selectively feeding sheets in an automatic and a manual modes includes a sensor means which is sensitive to a movement of a manual insertion tray to an operative position away from an inoperative one. When the sensor means has sensed such a movement of the tray while a sheet cassette is in a sheet feed position, a drive mechanism which is driven by a DC motor shifts the sheet cassette from the sheet feed position to a standby position. The tray is made up of a front tray and a rear tray which is connected to the front tray in an upwardly rotatably manner. While the tray is attached to the sheet feed position, a tray guide guides the movement of the front tray to the sheet feed position.

The above and other objects, features and advantages of the present invention will become more apparent from the following detailed description taken with the accompanying drawings.

DESCRIPTION OF THE PREFERRED EMBODIMENT

While the sheet feed device for a recording apparatus of the present invention is susceptible of numerous physical embodiments, depending upon the environment and requirements of use, the embodiment shown herein and described herein has been made, tested and used, and has performed in an eminently satisfactory manner.

Figure 1:
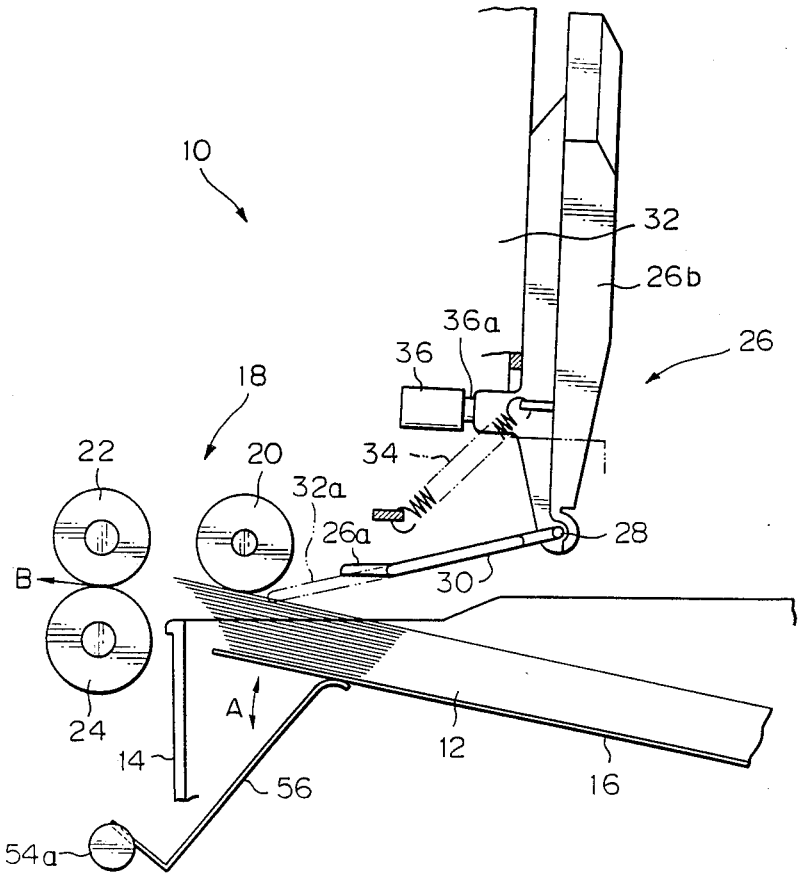
FIG. 1 is a front view of a sheet feed device embodying the present invention in which a manual insertion tray is situated in an inoperative position.
Figure 2:
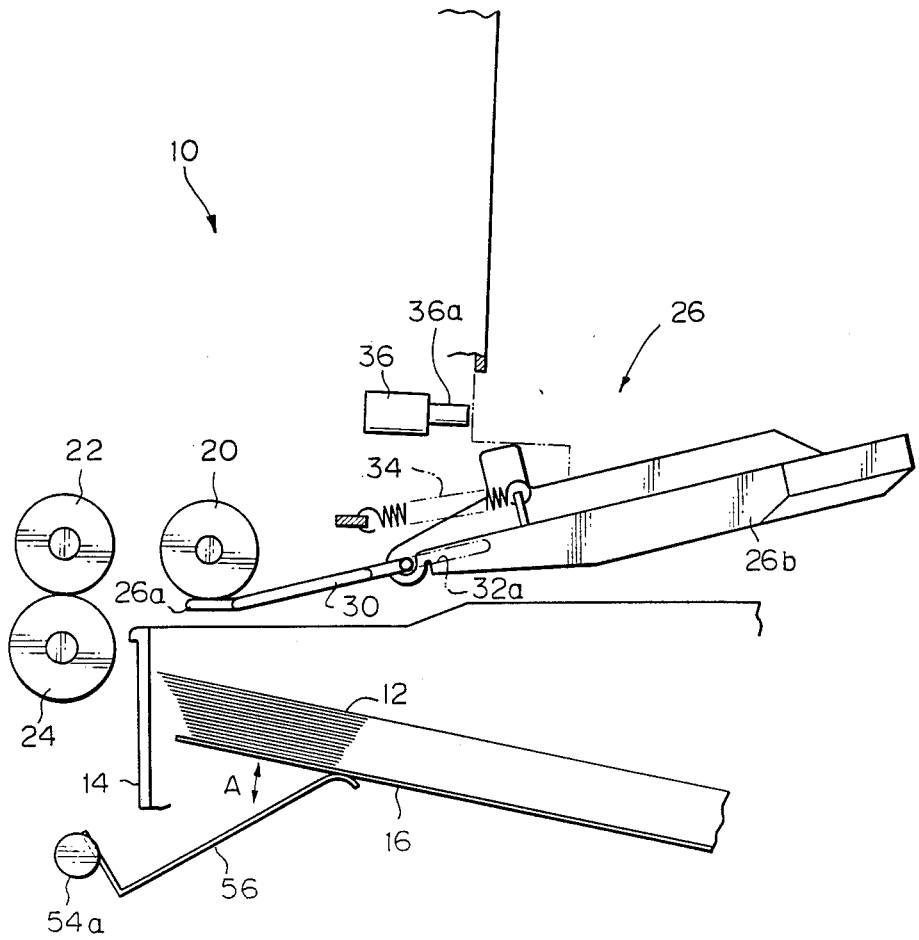
FIG. 2 is a view similar to FIG. 1 but showing the device with the tray held in an operative position.
Figure 3:
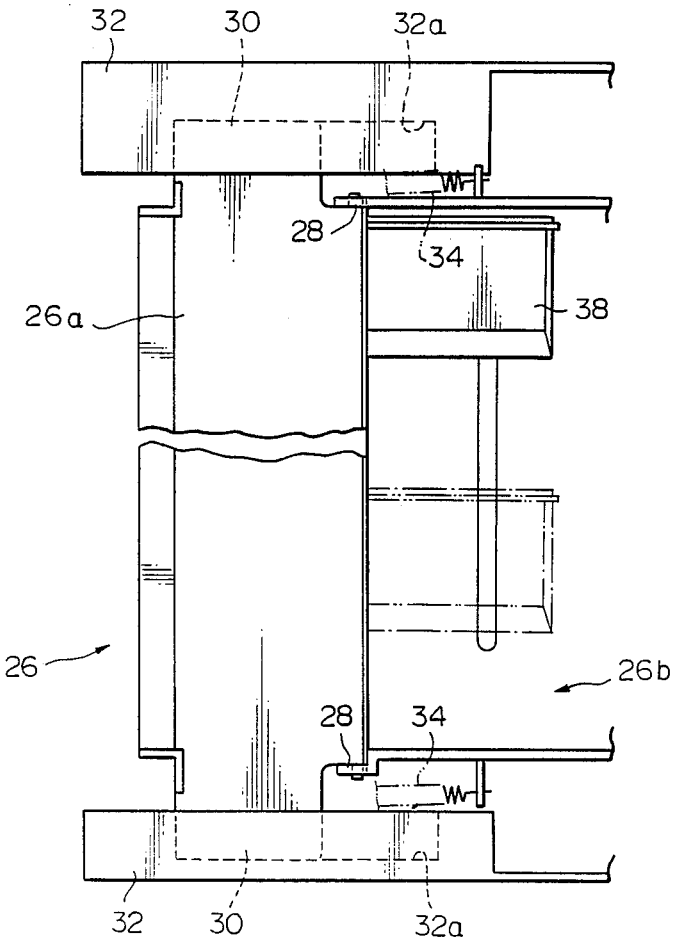
FIG. 3 is a plane view of the device shown in FIG. 2.

Referring to FIG. 1 of the drawings, a sheet feed device embodying the present invention is shown and generally designated by the reference numeral 10. The device 10 includes a sheet cassette, 14 which is detachably installed in a housing of a copier or the like and loaded with a stack of sheets 12. The sheet cassette 14 has a bottom plate 16 which is angularly movable about a fulcrum, now shown, as indicated by an arrow A. Specifically, the bottom plate 16 is movable between a sheet feed position as shown in FIG. 1 and a standby position as shown in FIG. 2. Sheet feed means 18 which is adapted to feed the sheets 12 one by one from the top of the stack as indicated by an arrow B comprises pickup rollers 20 which are moveable up and down in contact with the top of the stack 12, feed rollers 22, and reverse rollers 24 adapted to prevent two or more sheets to be fed together.

A manual insertion tray 26 is located in a position upward and to the right of the sheet feed means 18. As shown, the tray 26 is made up of a front tray, or main tray, **26*a* and a rear tray, or auxiliary tray, 26*b*. The auxiliary tray 26*b* is rotatably mounted on pins 28 which are positioned at the right end of the main tray 26*a* as viewed in FIG. 1. As best shown in FIG. 1, a pair of guide plates 30 extend each from one of opposite sides of the main tray 26*a* and each is received in a slot 32*a* formed through a side wall 32 of a machine in which the sheet feeder 10 is mounted, e.g. a copier. As shown in FIG. 1, each of the slots 32*a* is somewhat inclined to the left and down to extend as far as to be in proximity of the lower ends of the pickup rollers 20. In this construction, the tray assembly 26 is supported by the side walls 32 in such a manner as to be movable between an operative position, or sheet feed position, shown in FIG. 2 and an inoperative position, or receded position, shown in FIG. 1 along the slots 32*a***.

Tension springs 34 are each anchored at one end to one of the side walls 32 and at the other end to the auxiliary tray **26*b*, so that the auxiliary tray 26*b* is constantly biased counterclockwise about the pins 28. In the inoperative position as shown in FIG. 1, the auxiliary tray 26*b* is held in pressing contact with the side walls 32 of the machine by the tension springs 34. As shown in FIG. 1, the anchoring point of the tension springs 34 to the machine side walls 32 is positioned to the left and down from the anchoring point to the auxiliary tray 26*b*. Hence, while the auxiliary tray 26*b* is manually moved clockwise until it becomes flush with the main tray 26*a*, the tension springs 34 act to pull the tray assembly 26** bodily toward the operative position.

Sensor means 36 which is implemented by a microswitch has an actuator **36*a* which is constantly pressed by the auxiliary tray 26*b* to turn off the sensor means 36 while the latter is in the inoperative position. As the auxiliary tray 26*b* is moved away from the inoperative position, the microswitch 36 is turned on to generate a lower signal which will be described. The reference numeral 38** designates a movable guide plate.

Figure 4:
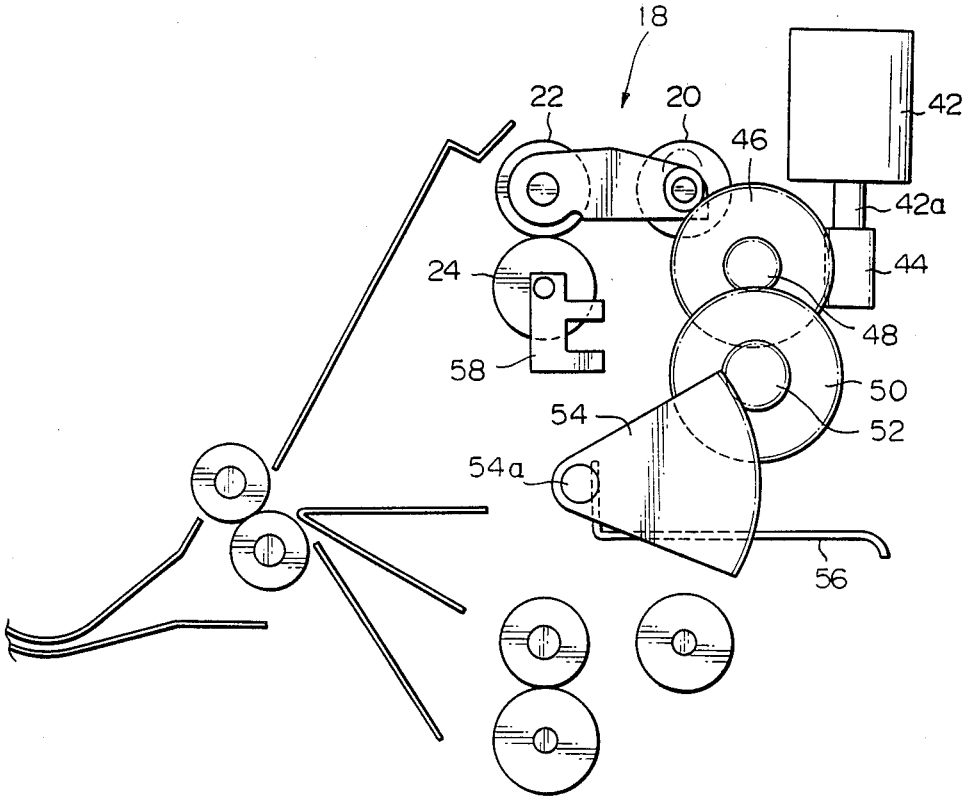
FIG. 4 is a front view of a drive system installed in a sheet feed device in accordance with the present invention.

Referring to FIG. 4, an arrangement for selectively moving the sheets 12 in the cassette 14 to a standby position and a feed position is shown. A DC motor 42 has an output shaft **42*a* on which a worm gear 44 is rigidly mounted. The worm gear 44 is meshed with a first gear 46, while a second gear 48 is fixed to the same shaft as the first gear 46. The second gear 48 is meshed with a third gear 50, while a fourth gear 52 is fixed to the same shaft as the third gear 50. The fourth gear 52 is meshed with a sector gear 54. A pusher arm 56 is rigidly mounted on a shaft 54*a* on which the sector gear 54 is mounted. The DC motor 42 and the gearing which extends from the worm gear 44 to the sector gear 54*a* constitute a drive system which is adapted to drive the pusher arm 56. The end of the pusher arm 56 remote from the shaft 54*a* is held in contact with the underside of the bottom plate 16 of the cassette 14. As the DC motor 42 rotates forwardly, the pusher arm 56 is rotated counterclockwise about the shaft 54*a*. The reference numeral 58 designates a cassette sensor which serves to monitor for the sheet size in the cassette 14 and whether the cassette 14** is accurately loaded.

Figure 5:
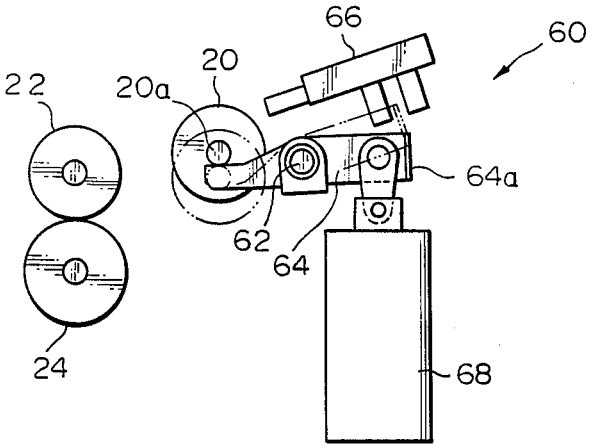
FIG. 5 is a front view showing a specific arrangement for the height detection of the instant invention.

Referring to FIG. 5, there is shown height sensor means 60 which is sensitive to a movement of the cassette bottom plate 16 from the standby position, which is set up when the cassette 14 is simply mounted in the copier, to the feed position in which the top of the sheet stack 12 abuts against the pickup rollers 20. As shown, the height sensor means 60 includes an arm 64 which is mounted to the side walls, not shown in FIG. 5, in such a manner as to be rotatable about a fulcrum 62. The arm 64 is provided at one end thereof with a piece **64*a* adapted to interrupt an optical path of a sensor 66. The other end of the arm 64 extends as far as the lower end of a shaft 20*a* which is substantially integral with the pickup rollers 20. While the sheet stack 12 is situated in the standby position, the piece 64*a* of the sensor means 60 interrupts the optical path of the sensor 66 due to the weight of the pickup rollers 20. As the sheet stack 12 makes contact with and pushes the pickup rollers 20 upward, the arm 64 is rotated clockwise due to its own weight to move the piece 64*a* away from the sensor 66 so that the arrival of the bottom plate 16 at the sheet feed position is sensed. The reference numeral 68 designates a solenoid adapted to temporarily move the pickup rollers 20 upward every time the sheet stack 12 is returned by the reverse rollers 24**.

Figure 6:
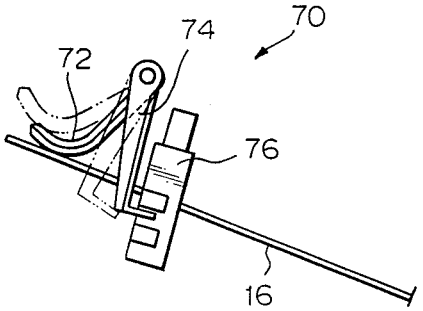
FIG. 6 is a front view showing a specific arrangement for end of sheet detection.

Referring to FIG. 6, sheet end sensor means which functions to see if the sheets 12 are present in the cassette 14 is shown and generally designated by the reference numeral 70. As shown, this means 70 includes a feeler 72 which makes contact with the top of the sheet stack 12 which is in the sheet feed position. As all the sheets 12 are fed out, the feeler 72 and a shutter plate 74 which follows the movement of the feeler 72 are caused to interrupt an optical path of a sensor 76.

FIG. 4 shows a situation in which the sheet cassette 14 is not loaded in the copier housing. As the cassette 14 is loaded accurately to a predetermined position inside of the copier, the cassette sensor 58 produces an output signal. In response to this signal, the DC motor 42 is rotated forward to raise the bottom plate 16 of the cassette 14 away from the standby position via the previously mentioned gearing and the pusher arm 56. This raises the sheet stack 12 together with the buttom plate 16. As soon as the sheet stack 12 makes contact with the pickup rollers 20 and further raises them upwardly, the height sensor means 60 shown in FIG. 5 senses the arrival of the bottom plate 16 at the sheet feed position. In response to an output signal of the sensor means 60, the DC motor 42 is deenergized so that the sheet stack 12 is brought to a halt at the sheet feed position (see FIG. 1).

Upon generation of a sheet feed command, the pickup rollers 20 feed a sheet at the top of the stack 12 between the feed rollers 22 and the reverse rollers 24. This sheet is driven by the feed rollers 22 as indicated by the arrow B while being prevented by the reverse rollers 24 from being accompanied by another sheet.

Assume that the operator desires a manually feed a sheet or sheets the sheet feeder 10 is in the condition as shown in FIG. 1. In this case, it is necessary to lower the sheet stack 12 loaded in the sheet cassette 14. Heretofore, such has been fulfilled by an arrangement in which when the manual insertion tray 26 is moved to an operative position, a pin associated with the tray actuates a group of levers to disengage the sector gear 54 and the fourth gear 52 from each other. This type of arrangement, as previously discussed, has various drawbacks such as the generation of annoying metallic noise.

In the illustrative embodiment, when the tray 26 is moved away from the inoperative position while the bottom plate 16 is in the sheet feed position, the microswitch 36 produces a signal indicative of the movement of the auxiliary tray **26*b* clear of the microswitch 38. In response, the DC motor 42 is rotated to lower the bottom plate 16 of the cassette 14, i.e. in the reverse direction. The rotation of the DC motor 42 moves the sheet stack 12 away from the pickup rollers 20 so that the tray 26 may be bodily moved to the operative position without any interference (see FIG. 2**).

Figure 7:
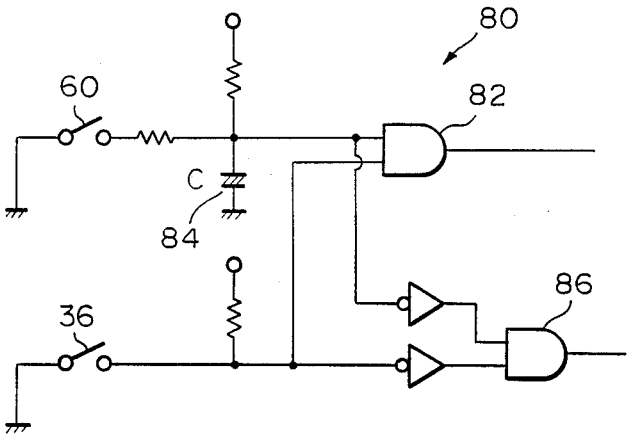
FIG. 7 is a circuit diagram representative of an implementation for producing an elevate signal and a lower signal.

Referring to FIG. 7, there is shown a specific logic circuit 80 adapted to produce an elevate signal and a lower signal for the DC motor 42. While the microswitch 36 is turned off, an elevate signal is produced via an AND gate 82 until the height sensor means 60 becomes turned on. As the microswitch 36 is turned on, a lower signal is produced while the height sensor means 60 is turned on and, even after it has become turned off, until the charge stored in a capacitor 84 is discharged.

The elevate signal and the lower signal provided as stated above are adapted, respectively, to drive the DC motor 42 forwardly and reversely. This may be implemented with a circuitry 90 shown in FIG. 8 by way of example. As a transistor 92 is turned on responsive to an elevate signal, a transistor 94 is also turned on to cause a current of one polarity, e.g., positive polarity to flow through the DC motor 42. Meanwhile, as a transistor 96 is turned on responsive to a lower signal, a transistor 98 is also turned on to allow a current of negative polarity to flow through the motor 42. In this manner, the motor 42 is driven forwardly by the elevate signal and reversely by the lower signal.

Figure 8:
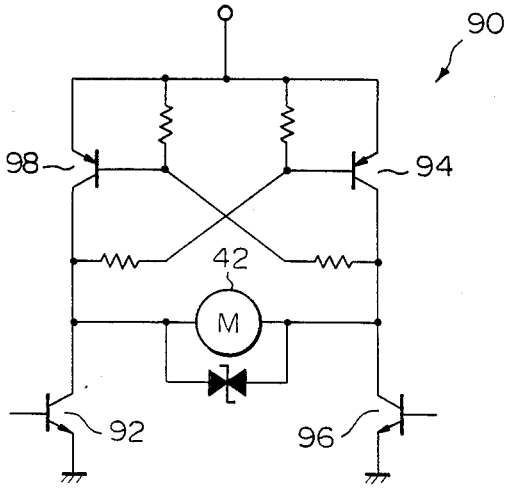
FIG. 8 is a diagram showing a circuit for driving a DC motor in the forward direction in response to the elevate signal and in the reverse direction in response to the lower signal.

If desired, the circuitries shown in FIGS. 7 and 8 may be replaced with other ones so long as they are capable of fulfilling similar roles. Further, it is of course permissible to use a central processing unit for direct programming.

As described above, when the manual insertion tray 26 is manually moved away from the inoperative position, the DC motor 42 is reversely rotated to allow the tray 26 to reach the operative position. In this instance, should the reverse rotation of the motor 42 be continued, the sector gear 54 and others might be lowered excessively to damage the drive arrangement. In the illustrative embodiment, the duration of reverse drive of the motor 42 may be limited to a desired on by suitably selecting the capacitor 84. Alternatively, the reverse rotation of the motor 42 may be stopped by utilizing an off-output of the height sensor means 60 or an on-output of the sheet end sensor means 70 each being responsive to lowering of the top of the sheet stack 12. Although the reverse rotation terminates within a short period of time as stated, the top of the sheet stack 12 is lowered by an additional amount associated with the inertia of the motor 42 which is involved in the lowering drive, thereby allowing the tray 26 to be moved to the desired position without obstruction.

The previously mentioned pins 28 do not constitute any essential part of the present invention. Where the pins 28 are omitted, some suitable means needs to be used to detachably mount the auxiliary tray **26*b* of the tray assembly 26 to the copier housing. Such means may be implemented by magnets fixed to the copier housing and those fixed to the auxiliary tray 26*b* of the tray assembly 26**.

In summary, it will be seen that the present invention achieves various advantages as enumerated below.

(1) Since a sheet cassette positioned in a sheet loading section is lowered by the reverse drive of a DC motor, the unpleasant metallic noise otherwise produced by metal members hitting against each other is eliminated. In addition, the number of necessary structural elements and, therefore, the cost is cut down.

(2) When one angularly moves a manual insertion tray to attach and detach it to and from a copier housing, the center of the angular movement is defined in the vicinity of a portion where a main and an auxiliary parts of the tray are interconnected. This reduces the space which the tray and its associated rotary section occupy, while increasing the allowable length of the tray.

Various modifications will become possible for those skilled in the art after receiving the teachings of the present disclosure without departing from the scope thereof.

What is claimed is:

1. A sheet feed device for a recording apparatus which selectively performs automatic sheet feed and manual sheet feed, comprising:

sheet load means to be loaded with a stack of sheets to be fed for fully supporting said stack of sheets;

cylindrical sheet feed means for sequentially picking up and feeding the sheets from a top of the stack which is loaded on said sheet load means;

electric drive means for driving the sheet load means such that the sheet load means is moved from a standby position to a sheet feed position so as to place the top sheet in said stack of sheets in contact with said cylindrical sheet feed means for maintaining the contact of said top sheet with said cylindrical sheet feed means and for moving said sheet load means from the sheet feed position to the standby position in a non-sheet feed condition;

manual sheet insert means movable angularly between the sheet feed position and a receded position which is remote from the sheet feed position, said manual insert means comprising a main tray which is movable as far as the sheet feed position at one end thereof and an auxiliary tray which is rotatably connected at one end thereof to the other end of said main tray, said manual sheet feed means having a pair of tray guide plates extending each from one of opposite sides of said main tray, each of which are received in a slot formed in a side wall of said recording apparatus, said manual sheet insert means being moved to the sheet feed position when said main tray and auxiliary trays become substantially flush with each other;

sensor means for sensing a movement of said manual insert means from the receded position to the sheet feed position in a manual insertion condition;

biasing means for biasing said manual sheet insert means toward the sheet feed position; and control means for controlling the drive means such that when said sensor means has sensed a movement of the manual insert means while the sheet load means is in the sheet feed position, the sheet load means is moved to the standby position away from the sheet feed position.

2. A sheet feed device as claimed in claim 1, in which said biasing means comprises springs which constantly bias said manual sheet insert means toward the sheet feed position while said auxiliary tray is angularly biased upwardly.

3. A sheet feed device as claimed in claim 1, in which the sheet load means comprises a sheet cassette having a bottom plate which is loaded with the sheets and movable between the sheet feed position and the standby position driven by the drive means.

4. A sheet feed device as claimed in claim 3, in which the sheet feed means comprises pickup rollers for picking up a sheet on the top of the stack in the sheet cassette which is held in the sheet feed position, feed rollers for feeding the picked up sheet, and reverse rollers for preventing sheets other than the top sheet from being fed.

5. A sheet feed device as claimed in claim 3, in which the drive means comprises an electric DC motor for generating torque, a gearing for transmitting the torque, and an arm for pushing the bottom plate of the sheet cassette from the standby position to the sheet feed position responsive to the transmitted torque.

6. A sheet feed device as claimed in claim 1, further comprising another sensor means for sensing whether the sheet load means is accurately mounted in a predetermined position.

* * * * *